United States Patent [19]

Kito et al.

[11] Patent Number: 4,817,827

[45] Date of Patent: Apr. 4, 1989

[54] ICE DISPENSER

[75] Inventors: Yoshikazu Kito; Toshihiko Ishikawa; Susumu Tatematsu, all of Toyoake, Japan

[73] Assignee: Hoshizaki Electric Co., Ltd., Toyoake, Japan

[21] Appl. No.: 178,348

[22] Filed: Apr. 6, 1988

[30] Foreign Application Priority Data

Apr. 13, 1987 [JP] Japan ..... 62-88881

[51] Int. Cl.[4] ..... B01F 15/02; F25C 15/08

[52] U.S. Cl. ..... 222/238; 62/344; 366/186

[58] Field of Search ..... 62/305, 344; 366/131, 366/151, 186, 295, 344; 222/238, 240, 241, 644, 146.6

[56] References Cited

U.S. PATENT DOCUMENTS

| | | | |
|---|---|---|---|
| 3,651,656 | 3/1972 | Esser et al. | 62/137 |
| 3,715,119 | 2/1973 | Shelley et al. | 222/241 |
| 3,913,343 | 10/1975 | Rowland | 62 X/344 |
| 4,227,377 | 10/1980 | Miller | 62/66 |
| 4,228,923 | 10/1980 | Barnard | 62 X/344 |
| 4,254,896 | 3/1981 | Stanford et al. | 366 X/295 |
| 4,276,750 | 7/1981 | Kawasumi | 222 X/146.6 |
| 4,496,087 | 1/1985 | Marks | 222/638 |
| 4,619,380 | 10/1986 | Brooks | 222/246 |

*Primary Examiner*—Andres Kashnikow
*Assistant Examiner*—Kevin P. Weldon
*Attorney, Agent, or Firm*—Wenderoth, Lind & Ponack

[57] ABSTRACT

An ice dispensing apparatus includes an ice dispensing lever which causes an ice dispensing signal to be produced when pressed, whereby an ice dispensing auger is driven for a period during which the ice dispensing signal is produced under the action of a relay ($X_5$). In response to the ice dispensing signal, a motor for driving an agitator installed within an ice storage chamber is driven for a first period ($t_1$) and then stopped. The rest state of the agitator driving motor is maintained until an integrated value resulting from integration of periods during which the ice dispensing signal is generated has attained the length of a second period ($t_2$). After the lapse of the second period ($t_2$), the agitator can be driven in response to subsequent generation of the ice dispensing signal.

8 Claims, 7 Drawing Sheets

ICE DISPENSER

CROSS-REFERENCE TO RELATED APPLICATION

Reference is hereby made to the following copending U.S. patent application concerning related subject matter and assigned to the assignee of the present invention:

"Ice Dispenser" by Yoshikazu Kito et al, assigned U.S. Ser. No. 127,500 and filed Dec. 1, 1987.

BACKGROUND OF THE INVENTION

1. Field of the Invention

The present invention relates generally to an ice dispenser apparatus for discharging or dispensing an amount of ice from an ice storage chamber in response to an ice dispensation request signal and more particularly to an ice dispenser apparatus of such a novel and improved structure in which pulverization of ice pieces or pellets stored within the ice storage chamber due to agitation thereof can be suppressed to a minimum to thereby prevent occurrence of a so-called arching phenomenon in which ice pellets are rigidly connected to one another through molten ice powder resulting from the pulverized ice pellets.

2. Prior Art

Heretofore, there have been used a variety of ice dispensing machines, a typical one of which is disclosed in U.S. Pat. No. 3,651,656 and which will be described below in respect to the structure having relevance to the understanding of the present invention by referring to FIGS. 6 and 7 of the accompanying drawings in which FIG. 6 shows the known ice dispenser with portions being broken away and FIG. 7 shows an electric circuit for controlling operation of the ice dispenser.

Now referring to FIG. 6 together with FIG. 7, when an ice dispensing switch 110 is closed as a result of accumulation of ice pellets within an ice storage chamber 128 as produced by an ice making mechanism of the structure known per se, a relay 100 is electrically energized through a contact 112of an ice dispensing timer 118 and an ice dispensation activating switch 114, whereby a relay contact 116 is closed. Consequently, a relay 104 is electrically energized through a contact 102 of a time delay relay, whereupon contacts 105 and 106 are closed to positions for activating a drive motor 146 which then rotates an ice dispensing auger 140 and an agitator 160 by means of a chain 156 suspended on and around sprockets 150, 152 and 170. Thus, the ice pellets within the ice storage chamber are caused to be dispensed through a discharge port 142. The drive motor 146 is energized so long as the ice dispensing switch 110 is closed or for a period preset in the ice dispensation timer.

In the ice dispenser disclosed in the U. S. Patent mentioned above, since the ice dispensing auger 140 serving for dispensation of ice and the agitator 160 for agitating the ice pellets stored within the ice storage chamber are rotated so long as the drive motor 146 is activated, some of ice pellets are likely to be pulverized into ice powder. when the pulverized ice enters gaps between the stored ice pellets and undergo melting and re-icing, and arching phenomenon occurs, whereupon the ice pellets are rigidly adhered to one another in an arch-like fashion. Once the arching phenomenon takes place, difficulty is encountered in satisfactorily discharging or dispensing all the ice pellets from the ice storage chamber regardless of rotation of the agitator, since these ice pellets bonded together and located outside of the region insusceptible to the action of the agitator can not be collapsed into separate ice pellets, giving rise to a problem. Besides, the arching phenomenon tends to disadvantageously increase motor torque required for rotating the agitator. Furthermore, the dispensed ice pellets tend to assume non-uniformity in respect to the size and shape, involving degradation in the quality of ice product possibly down to waste ice chips.

SUMMARY OF THE INVENTION

It is therefore a principal object of the present invention to provide an ice dispenser apparatus of such a structure in which tendency of ice pellets stored in an ice storage chamber being pulverized due to agitation thereof can be suppressed to a minimum preventing the occurrnce of the arching phenomenon within the ice storage chamber.

In view of the above object, an ice dispenser apparatus is provided according to the present invention in which one or more agitators for agitating ice pellets and an ice dispensing mechanism both installed within an ice storage chamber are driven in response to an ice dispensation request signal generated upon actuation of ice dispensing means to dispense ice pellets stored in the ice storage chamber, characterized by first means for causing the ice dispensing mechanism to operate over a period during which the ice dispensation signal makes appearance, and second means for driving the agitator for a first period in response to the generation of the ice dispensation request signal and subsequently inhibiting operation of the agitator until an integrated value of the periods during each of which the ice dispensation request signal is produced has attained a second period.

In the operation of the ice dispenser apparatus, the agitator means is driven for the first period of a relatively short duration (e.g. of 0.5 to 1 second), which agitator means is then stopped upon the lapse of the first period and subsequently caused to remain in the rest state until the integrated value of the ice dispensing signal durations becomes equal to that of the second period (e.g. of 10 to 20 seconds). By intermittently operating the agitator means in this manner, undesirable production of ice powder (i.e. pulverized ice) can be suppressed very significantly when compared with the prior art ice dispenser in which the agitator is continuously driven throughout the ice dispensing operation. In other words, the period during which the agitator is driven is set to a duration short but long enough to prevent the arching phenomenon from occurrence. Accordingly, the ice pellets can be protected against the agitating action of a long duration, whereby generation of the ice powder is decreased correspondingly. In this manner, occurrence of the arching phenomenon due to pulverization of ice, if any, can be limited only to the region surrounding the outer periphery of the rotating agitator, whereby the ice pellets bonded together can be again easily collapsed under the action of the agitator. In other words, with the rotation of the agitator over only a small angular distance (of about 30° to 60° in terms of angle of rotation), the ice pellets can be maintained in the substantially loose state to be easily fed into the dispensing auger.

BRIEF DESCRIPTION OF THE DRAWINGS

In the course of the following detailed description, reference will be made to the attached drawings in which.

DESCRIPTION OF THE PREFERRED EMBODIMENTS

Figure 1:
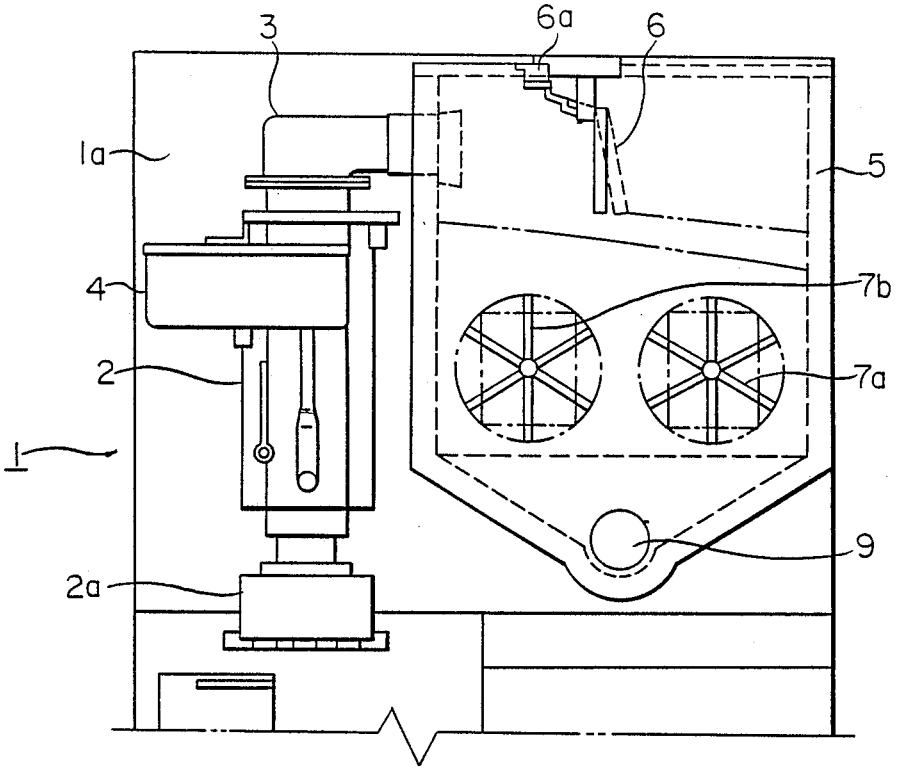
FIG. 1 shows schematically in a side view a typical ice dispenser apparatus to which the invention can be applied.
Figure 2:
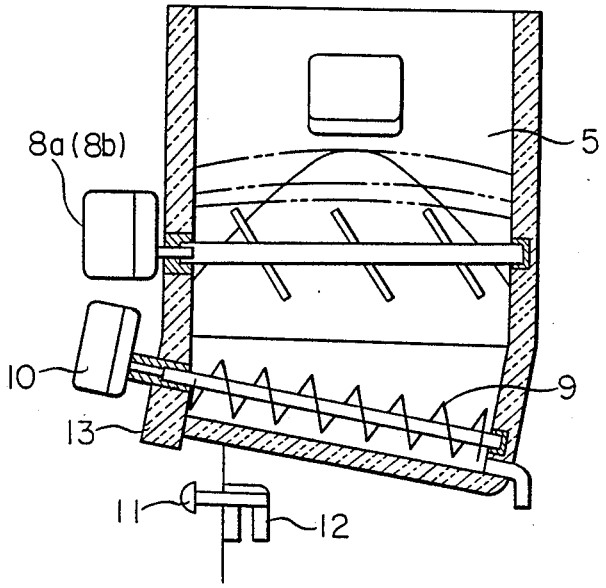
FIG. 2 is a vertical sectional view of the ice dispenser apparatus shown in FIG. 1 taken along a line passing an ice storage chamber provided in the apparatus.

Now, referring to the drawings and more particularly to FIGS. 1 and 2, a reference numeral 1 denotes a cabinet or housing of an ice dispenser constructed according to the present invention which is generally of a box-like configuration and includes a machine chamber 1*a* formed therein. Disposed fixedly within the machine chamber 1*a* are an ice making mechanism 2 having a discharge port 3 and a water tank 4 containing water to be supplied to the ice making mechanism 2. An ice storage chamber or stocker 5 made of a heat insulation material is mounted adjacent to the discharge port 3 of the ice making mechanism 2. Mounted within the ice storage chamber 5 at a top portion thereof is an ice storage level sensor 6 which servess to detect the state of the ice storage chamber 5 filled with ice pellets to the full capacity thereof and produces a signal for stopping operation of the ice making mechanism 2. Parenthetically, the ice making mechanism 2 may be implemented in the form of a so-called auger type ice making machine whose structure is well known in the art and thus omitted from detailed illustration. It should however be mentioned that in the auger-type 100 making machine, water fed into a cylinder from the water tank 4 is cooled by a coolant flowing through a cooling pipe wound around the outer periphery of the cylinder to thereby frozen to form an ice layer on the inner wall of the cylinder. The ice layer is then scraped off therefrom by means of a rotatable auger member driven by an auger drive motor 2*a*. The flakes of ice resulting from the scraping are compressed together to be reformed to columns of ice, which are then pushed upwardly to the discharge port 3.

Disposed within the ice storage chamber 5 in a manner known heretofore are agitators 7*a* and 7*b* for agitating the ice pellets stored within the ice storage chamber, which agitators also may be of known structure such as, for example, a rotatable shaft provided with a helical blade and driven by respective agitator drive motors 8*a* and 8*b* shown in FIG. 2.

Further, an ice dispensing switch 12 is provided at a position beneath the ice storage chamber 5 for producing an ice dspensation request signal in response to actuation of an ice dispensing lever 11. More specifically, an ice dispensing auger member 9 is rotatably mounted at the bottom of the ice storage chamber 5 and adapted to perform the ice dispensing operation upon actuation of the ice dispensing lever 11, while a motor 10 for driving the ice dispensing auger in response to the signal produced by the ice dispensing switch 12 is positioned externally of the ice storage chamber 5.

Figure 3:
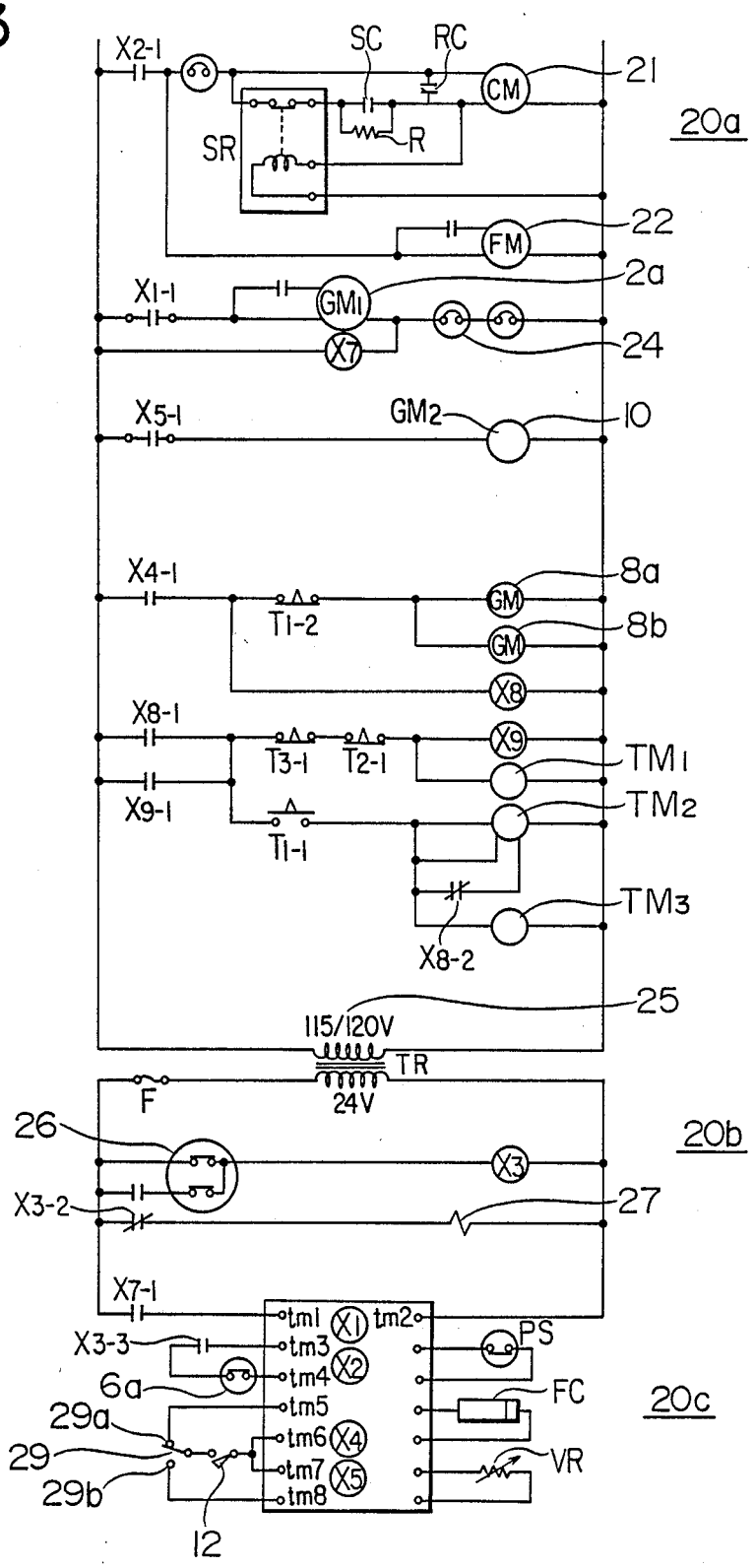
FIG. 3 is a schematic diagram of a control circuit for controlling operation of the ice dispenser apparatus shown in FIGS. 1 and 2 in accordance with an exemplary embodiment of the invention.

FIG. 3 shows in a diagram a control circuit for controlling operation of the ice dispenser according to an exemplary embodiment of the invention. The control circuit is composed of a refrigeration control circuitry 20*a* for controlling a refrigeration system for the ice making mechanism 2 which includes a compressor, a fan drive motor, a condenser, the auger drive motor 2*a* and others, a water supply control circuitry 20*b* including a float switch disposed within the water tank 4 and others, and a master control circuitry 20*c* implemented on a single chip or substrate which may also be constituted by a microcomputer or the like.

The compressor 21 which is a component of the refrigeration system is connected in series to a normally open contact $X_{2-1}$ of a second relay $X_2$ described in detail hereinafter, while the fan motor 22 which also constitutes a part of the refrigeration system is connected in parallel with the compressor 21, and the auger drive motor 2*a* of the ice making mechanism 2 (FIG. 1) is connected in series to a normally open contact $X_{1-1}$ of a first relay $X_1$ described hereinafter and a protector 24. A seventh relay $X_7$ is connected in parallel with the serial connection of the auger drive motor 2*a* and the above-mentioned normally open contact $X_{1-1}$. The motor 10 for driving the ice dispensing auger 9 constituting a main part of the ice dispensing mechanism is connected in series with a normally open contact $X_{5-1}$ of a fifth relay $X_5$. The agitator drive motors 8*a* and 8*b* for driving the agitators 7*a* and 7*b*, respectively, are connected in parallel with each other, wherein this parallel connection is connected in series to a contact $T_{1-2}$ of a first timer $TM_1$. The serial connection of the agitator drive motors 8*a* and 8*b* and the contact $TM_{1-2}$ of the first timer $TM_1$ is connected in parallel with an eighth relay $X_8$, wherein this parallel connection is connected to a power supply source by way of a normally open contact $X_{4-1}$ of a fourth relay $X_4$. A parallel connection of a ninth relay $X_9$ and the first timer $TM_1$ is connected in series with a contact $T_{2-1}$ of a second timer $TM_2$ and a contact $T_{3-1}$ of a third timer $TM_3$is connected in series with a contact $T_{1-1}$ of the first timer $TM_1$, wherein both serial connections mentioned above are connected to the power supply source through a parallel connection of a normally open contact $X_{8-1}$ of the eighth relay $X_8$and a normally open contact $X_{9-1}$ of the ninth relay $X_9$. The second timer $TM_2$ is connected to a normally closed contact $X_{8-2}$ of the eighth relay $X_8$ for integrating the periods during each of which the normally closed contact $X_{8-2}$ is opened through energization of the eighth relay $X_8$. The purpose of the second timer $TM_2$ is thus to integrate the durations of the periods during each of which the ice dispensing auger drive motor 10 is operated.

The water supply system control circuitry 20*b* and the master control circuitry 20*c* are connected to the low voltage side of a transformer 25 constituting a low voltage power supply source. In the water supply system control circuitry 20b, the float switch 26 for controlling the water level within the water tank 4 is connected in parallel with a normally open contact $X_{3-1}$ of a third relay $X_3$, wherein this parallel connection is connected in series to the third relay $X_3$. Further, a solenoid of a water supply valve 27 for supplying water to the water tank 4 is connected in series with a normally closed contact $X_{3-2}$ of the third relay $X_3$, and this serial connection is connected in series to the low voltage power supply source (i.e. the low voltage winding of the transformer 25).

The master control circuitry 20c has terminals $tm_1$ and $tm_2$ connected to the low voltage power supply source by way of a normally open contact $X_{7-1}$ of the seventh relay $X_7$, and includes first, second, fourth and fifth relays $X_1$, $X_2$, $X_4$ and $X_5$, respectively. Connected across the terminals $tm_3$ and $tm_4$ of the master control circuitry 20c is a serial connection of a normally open contact $X_{3-3}$ of the third relay $X_3$ and a switch contact 6a of the ice storage level sensor 6. Terminals $tm_5$ and $tm_8$ are connected to a change-over switch 29, while terminals $tm_6$ and $tm_7$ are connected to each other and to the ice dispensing switch 12. When the change-over switch 29 is thrown to a contact 29a for establishing a constant amount dispensing operation mode, the ice dispensing auger 9 is controlled in the mode for dispensing ice pellets in a predetermined constant amount. On the other hand, when the change-over switch 29 is thrown to a contact 29b for establishing a continuous ice dispensing mode, the ice dispensing auger 9 is controlled in the mode for continuously dispensing ice pellets.

Figure 3A:
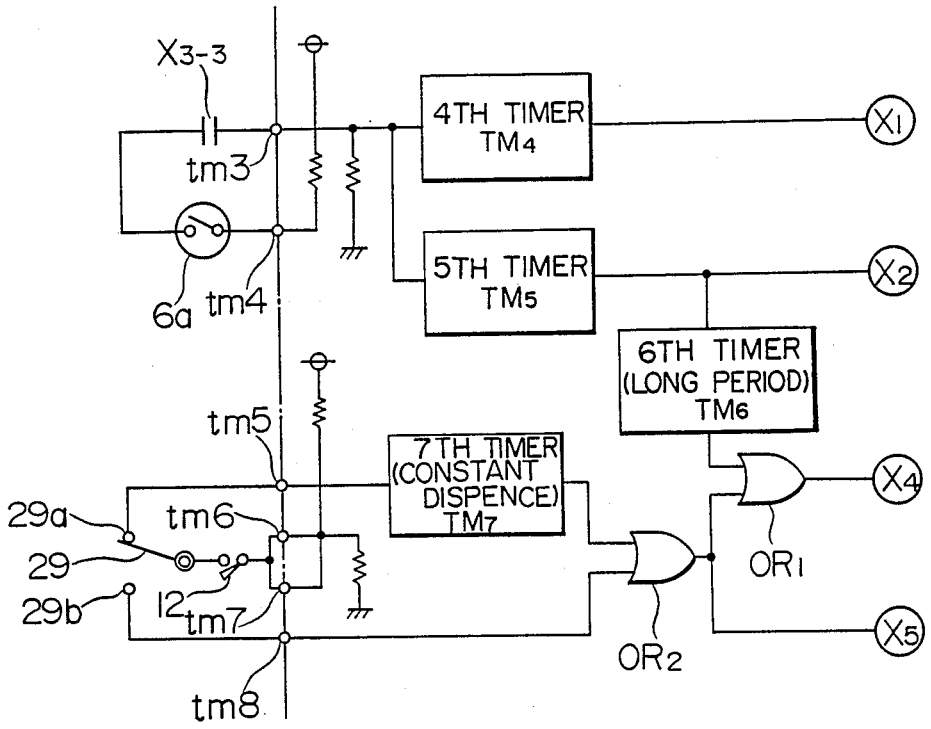
FIG. 3A is a circuit diagram showing a circuit configuration of a single-chip control circuitry incorporated in the control circuit shown in FIG. 3.

The master control circuitry 20c may be constituted by a microcomputer or realized in a conventional electric circuit composed of discrete elements. An exemplary internal circuit configuration of the master control circuitry 20c is shown in FIG. 3A in a block diagram. In this connection, it should be mentioned that the circuit arrangement shown in FIG. 3A is merely to serve for illustrating the internal function of the master control circuitry 20c and thus may be replaced by any other means so far as the equivalent function can be attained.

Figure 4:
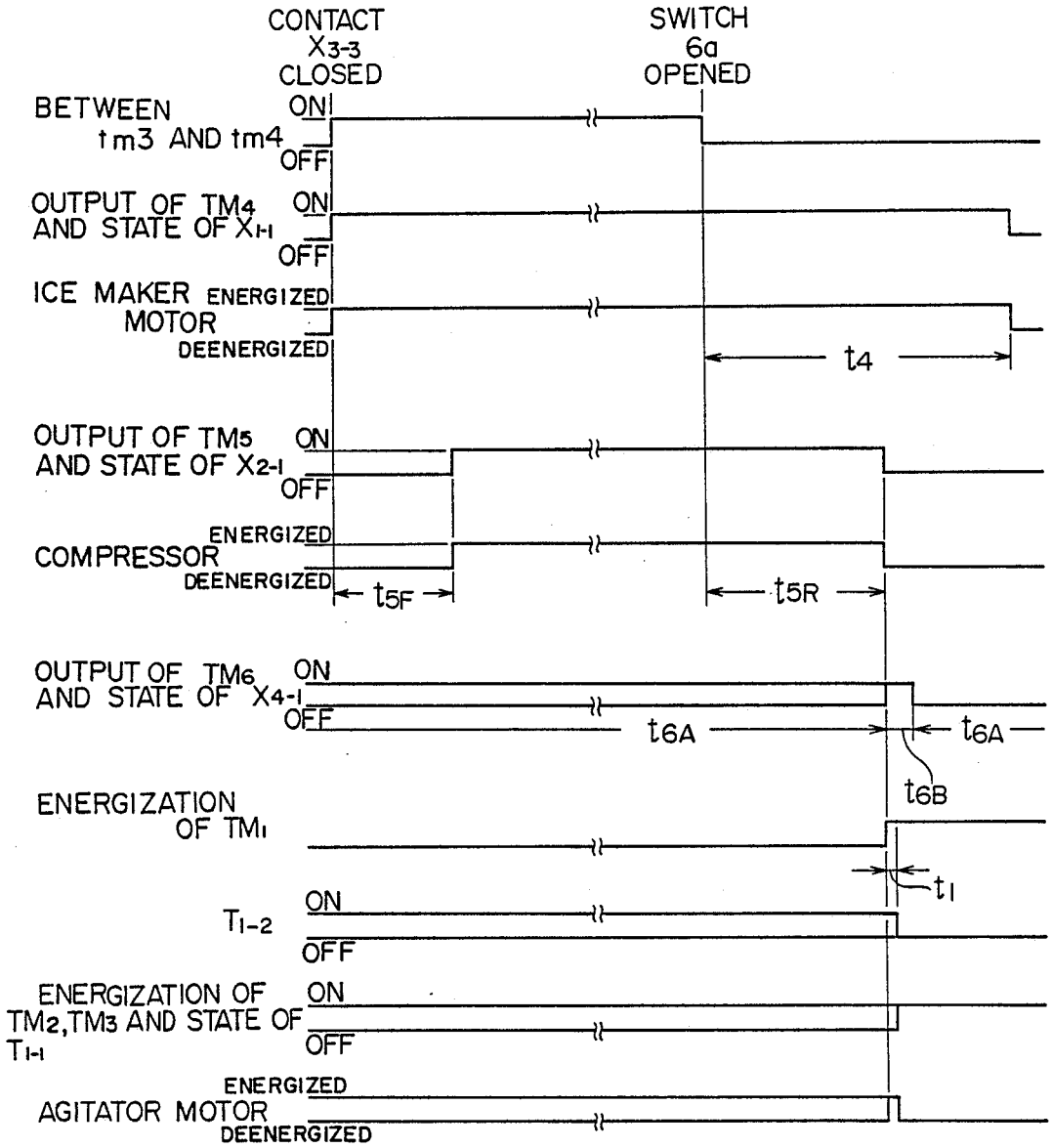
FIGS. 4 and 5 show various timing charts for illustrating operations of the circuits shown in FIGS. 3 and 3A.

Referring to the block diagram shown in FIG. 3A, the master control circuitry 20c includes a fourth timer $TM_4$, a fifth timer $TM_5$, a sixth timer $TM_6$ which may also be referred to as a long duration timer, and a seventh timer $TM_7$ which may also be referred to as the constant amount dispensing timer. The timing operations of these timers are illustrated in FIG. 4. Referring to FIG. 4, the fourth timer $TM_4$ responds to a closed circuit signal appearing at the terminal $tm_3$ to output a signal for energizing the first relay $X_1$ while it responds to disappearance of the closed circuit signal at the terminal $tm_3$ to interrupt the energization command signal to the first relay $X_1$ with a time lag $t_4$ (which may be on the order of 150 seconds). The fifth timer $TM_5$ responds to the closed circuit signal appearing at the terminal $tm_3$ to produce a signal for energizing the second relay $X_2$ with a time relay $t_{5F}$ (e.g. of 60 seconds) while interrupting the energization command signal to the second relay $X_2$ in response to disappearance of the above-mentioned closed circuit signal from the terminal $tm_3$ with a delay of time $t_{5R}$ (e.g. of 90 seconds). The long duration timer or sixth timer $TM_6$ is adapted to produce an ON signal for a predetermined short period $t_{6B}$ (e.g. of 2 seconds) after having been held in the OFF state for a predetermined long duration $t_{6A}$ (e.g. of two hours) and again assume the OFF state for the long period $t_{6A}$, which operation is automatically repeated. When the output signal of the fifth timer $TM_5$ changes from the ON state to the OFF state, i.e. when the energization command signal for the second relay $X_2$ disappears, the ON signal mentioned above is instantly produced for the predetermined short duration $t_{6B}$, upon the lapse of which the repetitive operation is automatically carried out. The seventh timer $TM_7$ also referred to as the constant amount dispensing timer is so designed as to produce the ON signal for a predetermined period $t_7$ from the time point when the input signal to the seventh timer $TM_7$ changes from OFF to ON state or level, as is illustrated in the timing chart shown in FIG. 5.

Now, operations of the ice dispenser apparatus and the control circuit shown in FIGS. 1 to 4 will be explained by referring to FIG. 5

When the power supply source (not shown) is turned on, the solenoid of the water supply valve 27 is electrically energized by way of the normally closed contact $X_{3-2}$ of the third relay $X_3$, as a result of which the water supply valve 27 is opened to start the water supply to the water tank 4. Upon attainment of a predetermined water level within the water tank 4 and hence within the icing cylinder of the ice making mechanism 2, the float switch 26 installed within the water tank 4 is closed, whereby the third relay $X_3$ is connected in series to the float switch 26 is electrically energized to open the normally closed contact $X_{3-2}$ thereof, resulting in that the water supply valve 27 is closed. Simultaneously with the opening of the normally closed contact $X_{3-2}$, the normally open contact $X_{3-3}$ is closed, whereby a closed circuit is established between the terminals $tm_3$ and $tm_4$ of the master control circuitry 20c by way of the contact 6a of the ice storage level sensor switch 6 when it is closed at this time point. As a result, the electronic fourth and fifth timers $TM_4$ and $TM_5$ of the master control circuitry 20c shown in FIG. 3A start the time count operation.

As described hereinbefore, since the fourth timer $TM_4$ produces the energization command signal for the first relay $X_1$ instantly upon formation of the above-mentioned closed circuit, the first relay $X_1$ is energized at first to close the normally open contact $X_{1-1}$ thereof shown in FIG. 3, whereby the auger drive motor 2a of the ice making mechanism 2 is driven. After the lapse of the time $t_{5F}$, the fifth timer $TM_5$ produces the energization command signal for the second relay $X_2$, whereupon the normally open contact $X_{2-1}$ of that relay $X_2$ is closed. Consequently, the compressor 21 and the fan motor 22 are driven to start the ice making cycle.

The ice pellets produced by the ice making mechanism 2 during the ice making operation thereof are discharged through the ice discharge port 3 into the ice storage chamber 5 to be progressively accumulated therein. When the ice storage chamber 5 becomes full of the ice pellets, the storage level sensor switch 6 is actuated to open the contact 6a thereof. As a result, the closed circuit path formed between the terminals $tm_3$ and $tm_4$ of the master control circuitry 20c is opened. Upon the lapse of the time $t_{5R}$ from this time point, the output signal of the fifth timer $TM_5$ is changed over from the ON state to the OFF state, whereby the energization command signal for the second relay $X_2$ is interrupted to stop the operation of the compressor 21 and the fan motor 22, while the long duration timer, i.e. the sixth timer $TM_6$ produces the ON signal for the predetermined short time $t_{6B}$ (e.g. of 2 seconds) upon detection of the ON-to-OFF changing-over of the fifth timer $TM_5$. The ON signal from the sixth timer $TM_6$ energizes the fourth relay $X_4$ through an OR circuit $OR_1$ for the predetermined short period $t_{6B}$, whereby the normally open contact $X_{4-1}$ of the fourth relay $X_4$ shown in FIG. 3 is closed.

In response to the closing of the normally open contact $X_{4-1}$ of the fourth relay $X_4$, the agitator drive motors 8a and 8b are activated through the contact $T_{1-2}$ of the first timer $TM_1$. At that time, the eighth relay $X_8$ which is connected in parallel with the motors 8a and 8b, as shown in FIG. 3, is also energized. Upon energization of the eighth relay $X_8$, the first timer $TM_1$ as well as the ninth relay $X_9$ is electrically energized through the normally open contact $X_{8-1}$ of the relay $X_8$, the contact $T_{2-1}$ of the second timer $TM_2$ and the contact $T_{3-1}$ of the third timer $TM_3$, whereby the ninth relay $X_9$ is held in the energized state (this state will be referred to as the self-holding state) through the normally open contact $X_{9-1}$.

Upon energization of the first timer $TM_1$, the timer contact $T_{1-1}$ is closed after lapse of a first period $t_1$ (preferably a relatively short time, e.g. of 0.5 to 1 second although it depends on the ice storage capacity and the structure), while the timer contact $T_{1-2}$ is opened to deenergize the agitator drive motors 8a and 8b. In this way, the agitator drive motors 8a and 8b are driven in response to the energization of the fourth relay $X_4$ only for the first period of the duration $t_1$ preset at the first timer $TM_1$. Further, the closing of the timer contact $T_{1-1}$ brings about energization of the second timer $TM_2$ and third timer $TM_3$ whose function will be described hereinafter in conjunction with the ice dispensing operation modes.

As will now be appreciated, the agitator drive motors 8a and 8b are driven only for the first preset period $t_1$ (e.g. of 0.5 second) after the lapse of the time $t_{5R}$ from the time point at which the ice storage level sensor switch 6a was opened by detecting the state of the ice storage chamber 5 filled with the ice pellets, whereby a cone-like heap of the ice pellets as accumulated is collapsed substantially flat. Subsequently, if the ice storage level sensor switch 6a still remains in the opened state, indicating the ice-filled state of the ice storage chamber 5, then the fourth timer $TM_4$ interrupts the energization command signal for the first relay $X_1$ after the lapse of the preset time $t_4$ from the opening of the ice storage level sensor switch 6a, resulting in that the normally open contact $X_{1-1}$ of the first relay $X_1$ is opened to deenergize the auger drive motor 2a, whereupon the ice making operation cycle comes to an end.

When ice pellets are held within the storage chamber 5 without being dispensed for a long period, there is a possibility that a smooth dispensing operation might be hindered. For the purpose of avoiding such undesirable situation, the agitators are periodically driven. To this end, the long duration timer, i.e. the sixth timer $TM_6$ is so set that the ON signal is outputted for a preset short period $t_{6B}$ (e.g. of 2 seconds) upon every lapse of a predetermined long period $t_{6A}$ (e.g. of 2 hours), as is illustrated in FIG. 4, to thereby energize the agitator drive motors for the first preset period $t_1$ (e.g. of 0.5 second) for making even the heap of ice pellets.

The ice dispensing operation (i.e. operation for dispensing ice pellets from the ice storage chamber 5) can be effected either in a constant amount dispensing mode in which a predetermined constant amount of ice is dispensed at a time or alternatively in a continuous dispensing mode in which ice dispensing operation is continued so long as the ice dispensing switch lever 11 is actuated. The constant amount dispensing mode is realized by throwing the change-over switch 29 shown in FIGS. 3 and 3A to the constant amount dispensing mode contact 29a, while the continuous dispensing mode is effectuated by throwing the change-over switch 29 to the continuous dispensing mode contact 29b.

Figure 5:
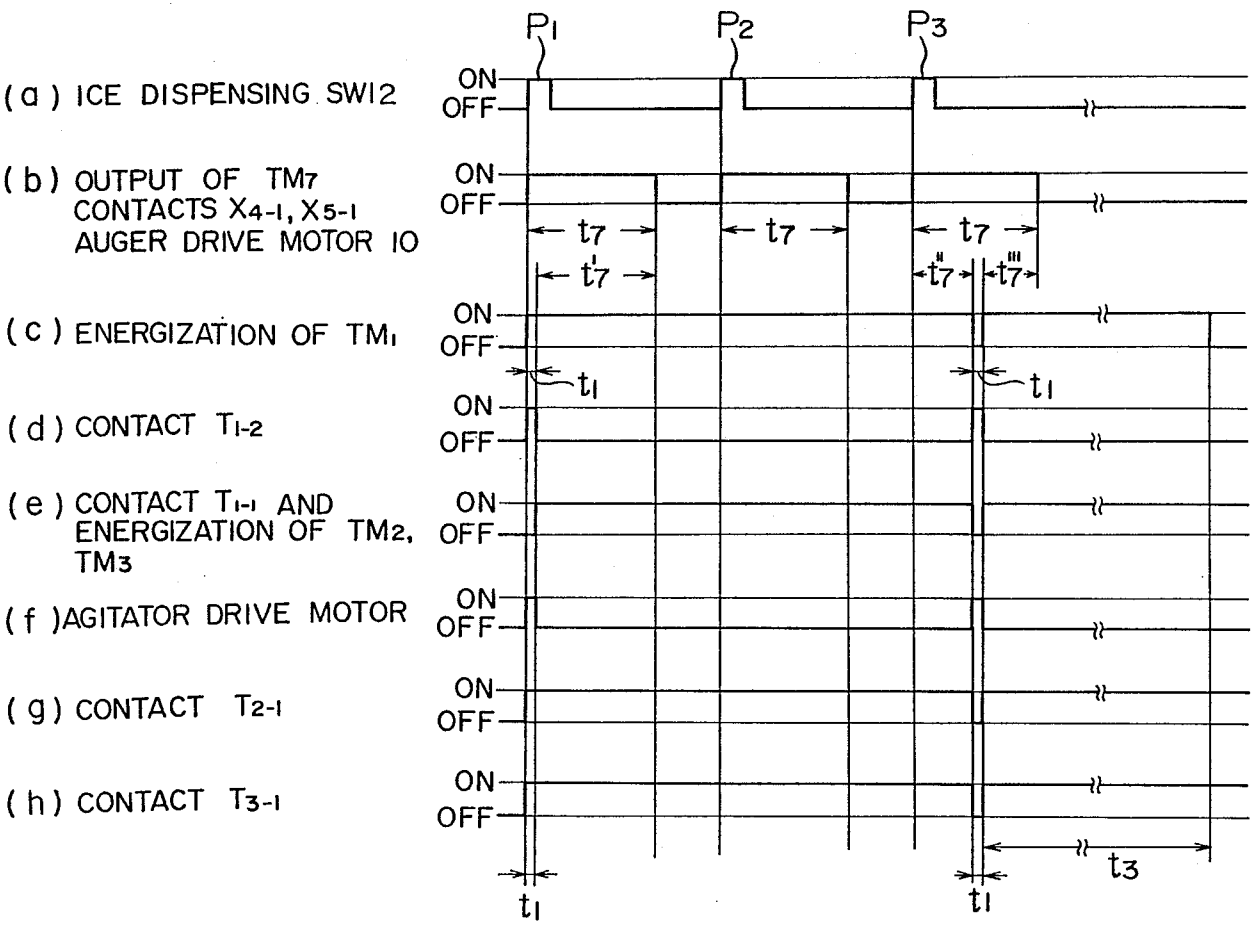
Figure 6:
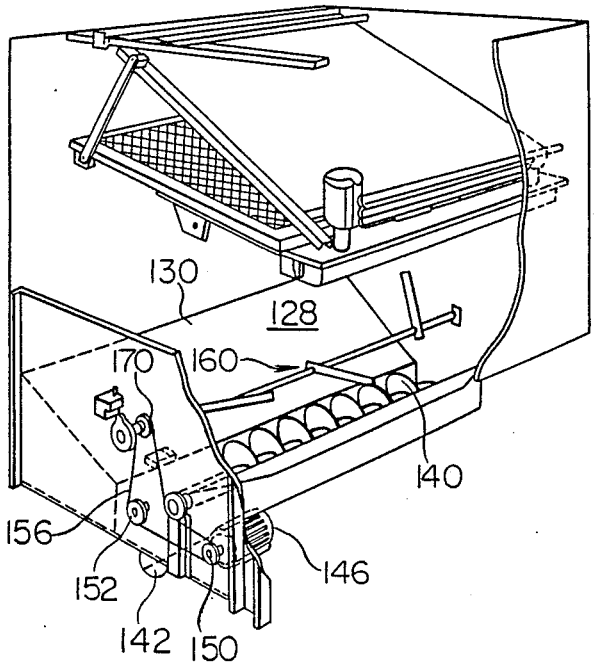
FIG. 6 PRIOR ART
FIG. 6 is a perspective view showing a main portion of a hitherto known ice dispenser apparatus with parts being broken away.
Figure 7:
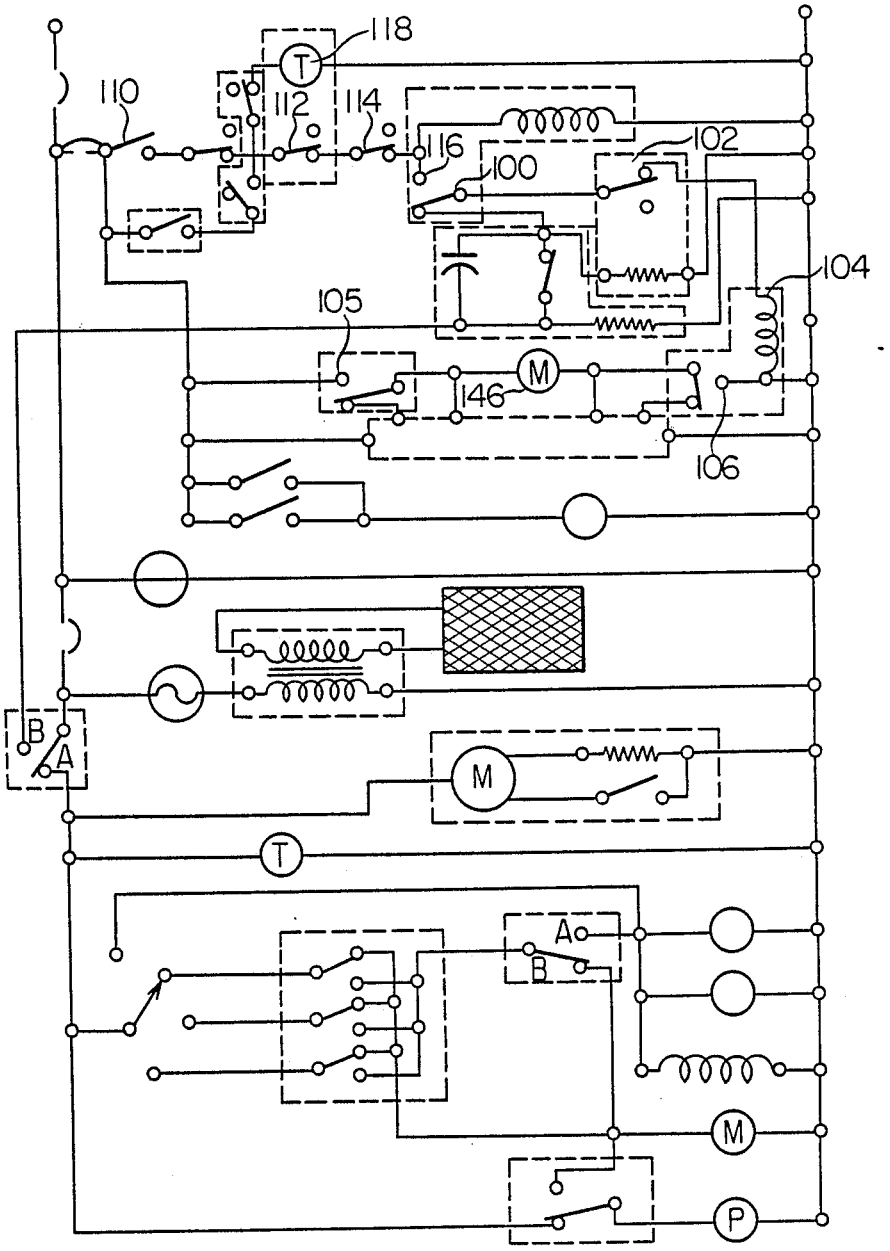
FIG. 7 PRIOR ART
FIG. 7 is a diagram showing a control circuit arrangement for the ice dispenser shown in FIG. 6.

FIG. 5 illustrates the timing operation in the constant amount dispensing mode. In this mode, when the switch 12 is closed by pushing the ice dispensing switch lever 11, the constant amount dispensing timer or the seventh timer $TM_7$ is turned on to produce an ice dispencing signal for causing the fourth and fifth relays $X_4$ and $X_5$ to be electrically energized, whereby the respective normally open contacts $X_{4-1}$ and $X_{5-1}$ are closed for a predetermined time $t_7$ starting from the turn-on of the seventh timer $TM_7$. In response thereto, the drive motors 8a and 8b for the agitators 7a and 7b which are connected in series to the normally open contact $X_{4-1}$ are energized to stir the heap of ice pieces for facilitating the dispensing thereof, while the drive motor 10 for the ice dispensing auger 9 connected in series to the abovementioned normally open contact $X_{5-1}$ is also rotated for a predetermined time duration $t_7$, whereby the ice pieces or pellets are dispensed through the ice dispensing port 13 outwardly from the ice storage chamber 5. In this manner, the dispensing operation continued for the predetermined time $t_7$ results in dispensation of a corresponding amount of ice from the storage chamber 5.

In this case, the period for which the ice dispensing auger drive motor 10 is energized is equal to the aforementioned predetermined time $t_7$ for which the constant amount dispensing timer $TM_7$ continues to produce the energization command signal. However, it should be noted that the time for which the agitator drive motors 8a and 8b are energized is limited to the duration $t_1$ (preferably 0.5 to 1 second, by way of example) set at the first timer $TM_1$, as described hereinbefore in conjunction with FIG. 4 and also can be seen in FIG. 5. More specifically, when the normally open contact $X_{4-1}$ is closed to electrically energize the agitator drive motors and the eighth relay $X_8$ to thereby energize the first timer $TM_1$ and the ninth relay $X_9$ by way of the normally open contact $X_{8-1}$ and the contacts $T_{3-1}$ and $T_{2-1}$, the ninth relay $X_9$ is held in the energized state by the normally open contact $X_{9-1}$ thereof. Subsequently, after the lapse of the first time or period $t_1$ set at the first timer $TM_1$,the contact $T_{1-1}$ is closed with the contact $T_{1-2}$ being opened. In this way, since the contact $T_{1-2}$ is opened upon the lapse of the first time or period $t_1$, the period during which the agitator drive motors are energized is set to the period $t_1$. The second timer $TM_2$ and the third timer $TM_3$ are also energized simultaneously upon closing of the contact $T_{1-1}$. However, the energization of the second timer $TM_2$ and the third timer $TM_3$ is continued through the normally open contact $X_{9-1}$ now closed, even after the normally open contact $X_{4-1}$ and hence the normally open contact $X_{8-1}$ are opened. Thus, even when the normally open contact $X_{4-1}$ is subsequently closed, the agitator drive motors can not be energized because the contact $T_{1-2}$ is in the opened state due to energization of the first timer $TM_1$. To allow the agitator drive motors to be driven, the time set at either the second timer $TM_2$ or the third timer $TM_3$ must elapse to open either the contact $T_{2-1}$ or $T_{3-1}$ to hereby release the ninth relay $X_9$ from the self-holding state.

The second timer $TM_2$ is connected to the normally closed contact $X_{8-2}$ of the eighth relay $X_8$. This contact $X_{8-2}$ is opened for a period during which thenormally open contact $X_{4-1}$ is closed to energize theeighth relay $X_8$, provided that the ice dispensation request signal is being produced. the second timer $TM_2$ integrates the time or period during which the normally open contact $X_{5-1}$ is opened. More specifically, since the normally open contact $X_{5-1}$ is closed to energize the ice dispensing auger drive motor so long as the ice dispensation request signal is produced, the second timer $TM_2$ integrates the time or period during which the ice dispensing auger drive motor is energized. In this connection, the second timer $TM_2$ is so designed that at the time point when the value of the integrated period or duration has attained a value of a second preset time $t_2$ (e.g. of 10 seconds), the second timer $TM_2$ is deenergized to open the contact $T_{3-1}$.

On the other hand, the third timer $TM_3$ is electrically energized upon closing of the timer contact $T_{1-1}$ and deenergized after the lapse of a third time or period $t_3$ (e.g. 20 of minutes) to open the contact $T_{3-1}$. The function of this third timer $TM_3$ is to release the ninth relay $X_9$ from the self-holding state upon the lapse of the third time or period $t_3$, even if the value resulting from the time integration effected by the second timer $TM_2$ remains short of the second period $t_2$ nevertheless of the lapse of a longer time because the normally open contact $X_{4-1}$ is not closed with the normally closed contact $X_{8-2}$ remaining closed for a long time. Such a situation may occur when the ice dispensing operation is not performed for a long time.

Referring to FIG. 5 at (a), when the ice dispensing switch 12 is first turned on (pulse $P_1$), the seventh timer $TM_7$ continues to output the ice dispensing signal for a time or duration $T_7$, as is shown in FIG. 5 at (b), whereby the ice dispensing auger drive motor 10 is driven. However, the agitator drive motor is driven only for the first period $t_1$, as can be seen in FIG. 5 at (f). Assuming now that the length of the second period $t_2$ finally attained through integration by the second timer $TM_2$ is given by:

$$t_2 = t_7' + t_7 + t_7''$$

the agitator drive motor 10 then remains in the deenergized state when the ice dispensing switch 12 is operated at a second time (pulse $P_2$), as shown in FIG. 5 at (a), although the ice dispensing drive motor 10 is energized. When the ice dispensing switch 12 is operated at a third time (pulse $P_3$), as shown in FIG. 5 at (a), the time ($t_2$) integrating operation of the timer $TM_2$ comes to an end. Accordingly, after the lapse of the period $t_7''$ during which the seventh timer $TM_7$ continues to produce the ice dispensing signal, the contact $T_{2-1}$ is instantaneously opened, as shown in FIG. 5 at (g), to thereby release the ninth relay $X_9$ from the self-holding state. As a result, the first time $TM_1$, the second timer $TM_2$ and the third timer $TM_3$ are reset to the initial state. At this time point, the contact $X_{4-1}$ is opened, while the contact $X_{8-1}$ is closed, resulting in that the ninth relay $X_9$ is again set to the self-holding state, whereby the agitator drive motor is again energized for the first period $t_1$, as will be seen in FIG. 5 at (f). In the assumed operation illustrated in FIG. 5, the ice dispensing switch subsequently remains unoperated. Accordingly, the integrated value in the second timer $TM_2$ remains unincremented. At a time point when the third period $t_3$ has elapsed, the contact $T_{3-1}$ of the third timer $TM_3$ is instantaneously opened, as will be seen in FIG. 5 at (h), whereby the ninth relay $X_9$ is released from the self-holding state. Thus, the first timer $TM_1$, the second timer $TM_2$ and the third timer $TM_3$ are reset to the initial state.

In this manner, the agitators *7a* and *7b* are actuated only for the duration and the number of times as required for ensuring the smooth ice dispensing operation. More specifically, when the time set at the seventh electronical timer $TM_7$ is shorter than the time set at the second timer $TM_2$, the durations of repeated operations of the timer $TM_7$ (i.e. durations of the repetitive ice dispensing operations) are integrated by the second timer $TM_2$, wherein the agitators *7a* and *7b* are rotated for the first period $t_1$ in respose to the ice dispensation request signal when the total sum of the integrated durations has attained a preset value. In case the amount of ice to be dispensed at a time in the constant amount dispensing mode is large with the time $t_7$ longer than $(t_1+t_2)$ being set at the constant amount dispensing timer $TM_7$, the agitators *7a* and *7b* are operated intermittently for the first time or duration $t_1$ upon every lapse of the period $(t_1+t_2)$. By setting the durations $t_1$ and $t_2$ such that the relation between the amount $Q_1$ of ice which can be easily dispensed by rotating the agitators for the duration $t_1$ and the amount $Q_2$ of ice dispensed by the ice dispensing auger for the duration $t_2$ satisfies the condition that $\frac{2}{3}Q_1 < Q_2 < Q_1$, the agitators *7a* and *7b* are driven within the range in which the amount of ice required for the ice dispensing auger 9 to transport can be supplied. In any case, the control is performed such that the ratio between the duration for which the agitators are driven and the duration required for ice dispensation is maintained constant, whereby pulverization of ice can be suppressed to a minimum. Further, so long as the length of the second period as integrated remains short of the third period which is set sufficiently longer than the second period, the agitators are allowed to be driven every time the ice dispensation request signal is generated, presenting thus no problem in the ice dispensing operation.

Next, description will be turned to the operation in the continuous dispensing mode. In contrast to the constant amount dispensing mode in which the ice dispensation request signal continues to be generated for the predetermined duration $t_7$ i response to the actuation of the ice dispensing lever 11, the ice dispensation request signal continues to be generated so long as the ice dispensing lever 11 is pressed in the case of the continuous dispensing mode. Except for this, the continuous dispensing mode is identical with the constant amount dispensing mode. In the continuous dispensing mode, the ice dispensing signal, i.e. the signal for energizing the fourth relay $X_4$ and the fifth relay $X_5$ is produced continuously so long as the ice dispensing switch lever 11 is pressed, whereby the normally open contacts $X_{4-1}$ and $X_{5-1}$ of these relays are closed to energize the ice dispensing auger drive motor 10 as well as the agitator drive motors *8a* and *8b*. However, the rotation of the agitator drive motors *8a* and *8b* is limited to the time span or period $t_1$ from the time point when the ice dispensing lever 11 has been operated, so that the agitator drive motors *8a* and *8b* remain in the deenergized state regardless of the repeated actuation of the ice dispensing switch lever 11, until the second period $t_2$ has been reached through integration by the second timer $TM_2$ or the third timer $TM_3$ has counted up to the third period $t_3$. Further, when the ice dispensing switch lever 11 is pressed continuously for a period longer than $(t_1+t_2)$, the ice dispensing auger drive motor 10 continues to run for that period. However, the agitator drive motors 8*a* and 8*b* are operated intermittently only for the first timer period $t_1$ upon every lapse of the duration $(t_1+t_2)$, as described hereinbefore.

In conjunction with the operation illustrated in FIGS. 4 and 5, it is preferred that the first, second and third timers $TM_1$, $TM_2$ and $TM_3$ be provided with first, second and third time adjusting means so that the first, second and third timer periods $t_1$, $t_2$ and $t_3$ can be adjusted in a variable manner.

As will be appreciated from the foregoing description, the fifth relay $X_5$ constitutes a first means for activating the operation of the ice dispensing mechanism and more specifically the ice dispensing auger 9 over a period during which the ice dispensation request signal is issued, while the fourth relay $X_4$, the eighth relay $X_8$, the ninth relay $X_9$, the first timer $TM_1$, the second timer $TM_2$ and the third timer $TM_3$ cooperate together to constitute second means for energizing the agitators for the first period $t_1$ and subsequently deenergizing the agitators for the second period $t_2$ in response to the ice dispensation request signal generated only once.

It should be mentioned again that in the ice dispensing modes described hereinbefore in conjunction with FIG. 5, the agitators 7*a* and 7*b* are not rotated continuously over the whole ice dispensing period during which the ice dispensing auger drive motor is continuously energized but is rotated only during the possible shortest period which is required for assuring the smooth and satisfactory ice dispensing operation by virtue of such control that the ratio of the period during which the agitators are rotated to the period during which the ice dispensing auger drive motor is driven is maintained constant. This is advantageous in that not only the amount of pulverized ice possibly produced during the rotation of the agitator can be suppressed to a minimum, but also the ice powder as produced can be discharged out of the ice storage chamber together with the ice pellets without being left within the chamber, whereby the so-called arching phenomenon can be positively prevented from occurring in the ice storage chamber.

Although the invention has been described as applied to the ice dispenser in which a pair of agitators are employed, it should be appreciated that the invention is never restricted to the number of the agitators. The invention can be applied to the ice dispenser equipped with one or three or more agitators for assuring the improved ice dispensing operation while suppressing the occurrence of the arching phenomenon.

Further, although description has been made in conjunction with the illustrated embodiment to the effect that the second means constituted by the first timer $TM_1$, the second timer $TM_2$, the third timer $TM_3$, the eighth relay $X_8$, the ninth relay $X_9$, etc. for controlling the rotation of the agitator drive motors 8*a* and 8*b* are incorporated in the refrigeration system control circuitry 20*a*, it will be readily understood by those skilled in the art that the second means may be implemented in the master control circuitry 20*c* in the form of electronic timers and relays, wherein the agitator drive motor is directly energized through the normally open contact $X_{4\text{-}1}$ of the fourth relay $X_4$. With this arrangement, the number of wiring steps can be reduced, whereby the invention can be carried out economically.

As will be seen, the ice dispenser according to the present invention which is so arranged as to inhibit the rotation of the agitator(s) for a predetermined period independent of the ice dispensing period in the ice dispensing modes and in which the agitators are rotated only for the shortest time required to assure the satisfactory ice dispensing operation upon every lapse of the predetermined period can suppress the amount of pulverized ice as produced to a minimum to thereby prevent the arching phenomenon which otherwise would hinder the ice pellet dispensing operation.

While a specific embodiment of the invention has been described in detail, it will be appreciated by those skilled in the art that various modifications and alternatives to those details could be developed in light of the overall teachings of the disclosure Accordingly, the particular arrangements disclosed are meant to be illustrative only and not limiting as to the scope of the invention which is to be given the full breadth of the appended claims and all equivalents thereof.

What we claim is:

1. An ice dispenser apparatus including an ice storage chamber, an ice dispensing mechanism mounted for rotation within said ice storage chamber to dispense outwardly ice pellets stored within said ice storage chamber, means operatively connected to said ice dispensing mechanism for generating an ice dispensing signal to trigger operation of said ice dispensing mechanism, agitator means mounted for rotation within said ice storage chamber for agitating the ice pellets within said ice storage chamber, and drive means coupled to said agitator means for driving said agitator means, said drive means being operatively coupled to said ice dispensation signal generating means and adapted to be energized in response to said ice dispensing signal, the improvement comprising:

first means ($X_5$) operatively coupled to said ice dispensation signal generating means and said ice dispensing mechanism for causing said ice dispensing mechanism to be operated over a period during which said ice dispensing signal is issued; and second means ($X_4$, $X_8$, $X_9$, $TM_1$, $TM_2$, $TM_3$) operatively coupled to said ice dispensation signal generating means and said drive means for energizing said drive means for a first period ($t_1$) in response to generation of said ice dispensing signal and for deenergizing said drive means for a second period ($t_2$) until the integrated value of the periods during which said ice dispensing signal is issued has attained the length of a second period ($t_2$).

2. An ice dispenser apparatus as set forth in claim 1, wherein said second means includes means for resetting the operation for deenergizing said drive means unless said integrated value of the period during which the ice dispensing signal is genrated attains the length of said second period ($t_2$) within a third period ($t_3$) which is set sufficiently longer than said second period.

3. An ice dispenser apparatus as set forth in claim 1, wherein said second means is operative to repeat a cycle including operation for energizing said drive means over said first period and operation for deenergizing said drive means over said second period when the period during which said ice dispensing signal is issued exceeds a sum of said first and second periods.

4. An ice dispenser apparatus as set forth in claim 2, wherein said second means includes first and second time adjusting means capable of adjusting the durations of said first and second periods, respectively.

5. An ice dispenser apparatus as set forth in claim 4, wherein said second means includes third time adjusting means capable of adjusting the duration of said third period.

6. An ice dispenser apparatus as set forth in claim 1, further including an ice dispensing switch, and a change-over switch connected in series to said ice dispensing switch for changing over the ice dispensing operation mode of said ice dispenser to either a continuous dispensing mode or a constant amount dispensing mode, wherein said change-over switch includes a continuous dispensing mode enabling contact for enabling said continuous dispensing mode by outputting the contact signal produced by said ice dispensing switch intact as the ice dispensing enable signal and a constant amount dispensing mode enabling contact connected in series to a constant amount dispensing timer ($TM_7$) for producing an ice dispensing enable signal (ON signal) for a predetermined period ($t_7$) starting from the time point at which said ice dispensing switch is closed.

7. An ice dispenser apparatus as set forth in claim 1, further including a stored ice sensor disposed within said ice storage chamber, and a long duration timer ($TM_6$) capable of counting a predetermined long period ($t_{6A}$) when said stored ice sensor produces a signal indicating the ice-filled state of said ice storage chamber fully filled with the ice over a period exceeding said predetermined long period, wherin said long duration timer ($T_6$) causes said second means to output the signal for driving said drive means for a predetermined short time ($t_{6B}$) when said long duration timer ($T_6$) has counted up to said predetermined long period ($t_{6A}$).

8. An ice dispenser apparatus as set forth in claim 7, wherein said second means produces the driving signal for driving said drive means over said predetermined short period until stopping the ice making operation is stopped in response to the signal produced by said stored ice sensor indicating said ice-filled state of said ice storage chamber.

* * * * *